US006299425B1

(12) United States Patent
Hirano et al.

(10) Patent No.: US 6,299,425 B1
(45) Date of Patent: Oct. 9, 2001

(54) MEMBER HAVING SLIDING CONTACT SURFACE, COMPRESSOR AND ROTARY COMPRESSOR

(75) Inventors: Hitoshi Hirano, Nishinomiya; Keiichi Kuramoto, Kadoma; Yoichi Domoto, Hirakata; Naoto Tojo, Ikoma, all of (JP)

(73) Assignee: Sanyo Electric Co., Ltd., Osaka (JP)

( * ) Notice: Subject to any disclaimer, the term of this patent is extended or adjusted under 35 U.S.C. 154(b) by 0 days.

(21) Appl. No.: 09/500,533

(22) Filed: Feb. 9, 2000

Related U.S. Application Data

(62) Division of application No. 08/895,999, filed on Jul. 17, 1997, now Pat. No. 6,071,103.

(30) Foreign Application Priority Data

Jul. 18, 1996 (JP) ..... 8-189627
Jun. 30, 1997 (JP) ..... 9-174276

(51) Int. Cl.[7] ..... F04C 18/356; B32B 5/14; B32B 7/02; B32B 9/00

(52) U.S. Cl. ..... 418/63; 418/152; 418/178; 428/408; 428/610; 428/634

(58) Field of Search ..... 418/63, 152, 178; 428/408, 610, 634

(56) References Cited

U.S. PATENT DOCUMENTS

| | | | | |
|---|---|---|---|---|
| 4,842,937 | | 6/1989 | Meyer et al. | 428/408 |
| 5,021,629 | | 6/1991 | Shimomura | 418/178 |
| 5,237,967 | | 8/1993 | Willermet et al. | 428/408 |
| 5,308,707 | * | 5/1994 | Cellier et al. | 428/610 |

FOREIGN PATENT DOCUMENTS

| | | | | |
|---|---|---|---|---|
| 61-241484 | * | 10/1986 | (JP) | 418/178 |
| 2-308996 | * | 12/1990 | (JP) | 418/178 |
| 8-177772 | | 7/1996 | (JP) . | |

* cited by examiner

*Primary Examiner*—John J. Vrablik
(74) *Attorney, Agent, or Firm*—Arent Fox Kintner Plotkin & Kahn, PLLC

(57) ABSTRACT

A member is disclosed which includes a hard carbon film provided through an interlayer or directly on a main body such as a vane. A mixed layer is formed within the main body or interlayer adjacent to an outer surface of the main body or interlayer. The mixed layer contains carbon and a constituent element of either the main body or the interlayer. The mixed layer has a carbon content gradient in its thickness direction so that a carbon content in a thickness portion thereof closer to an outer surface of the mixed layer is higher than in a thickness portion thereof remoter from the outer surface of the mixed layer.

12 Claims, 19 Drawing Sheets

MEMBER HAVING SLIDING CONTACT SURFACE, COMPRESSOR AND ROTARY COMPRESSOR

This application is a divisional of application Ser. No. 08/895,999, filed on Jul. 17, 1997, now U.S. Pat. No. 6,071,103.

BACKGROUND OF THE INVENTION

1. Field of the Invention

The present invention relates to a member having a sliding contact surface, a compressors and a rotary compressor respectively incorporating the member.

2. Description of Related Art

The rotary compressors for use in refrigerating facilities, air-conditioning equipments and the like have been placed under heavier duty conditions with their recent improvements in performance and capability.

In such rotary compressors, a leading end of a vane is brought into constant contact with a peripheral sliding portion of a roller such as by biasing means. This disadvantageously produces sludges interior of a cylinder housing, the vane and the roller. These sludges cause blockages in a refrigeration system, specifically in a capillary tube to result in a reduced refrigeration capability of the system.

When the situation goes worst, it possibly becomes impossible to supply a refrigerant carrier through the capillary tube to thereby give a destructive damage to the rotary compressor.

Accordingly, there remains a need to provide a member having a sliding contact surface, such as for use in compressors, rotary compressors and the like, which produces less sludges and has an improved wear resistance relative to conventional members and which can be steadily used for a prolonged period of time.

SUMMARY OF THE INVENTION

It is an object of the present invention to provide a member having a sliding contact surface which has a superior wear resistance and is steadily workable for a long period of time, and to provide a compressor and a rotary compressor using such a member.

In accordance with a first aspect of the present invention, a member is provided which includes a main body having a sliding contact surface, a hard carbon film provided on the sliding contact surface and a mixed layer formed within a thickness region of the main body adjacent to the sliding contact surface. The mixed layer is comprised of carbon and a constituent element present in the thickness region of the main body and has a carbon content gradient in its thickness direction so that a carbon content in a thickness portion thereof closer to an outer surface of the mixed layer is higher than in a thickness portion thereof remoter from the outer surface of the mixed layer.

In a preferred embodiment of the invention in accordance with the first aspect, the mixed layer is formed by introducing carbon into the region within the main body and adjacent to the sliding contact surface thereof.

The member in accordance with the first aspect has the hard carbon film on the sliding contact surface to exhibit an excellent wear resistance. Also, the formation of the mixed layer adjacent to the sliding contact surface of the main body provides a good adherence of the main body to the hard carbon film so that the member can be steadily used for a prolonged period of time without experiencing delamination.

In accordance with a second aspect of the present invention, a member is provided which includes a main body having a sliding contact surface, an interlayer provided on the sliding surface of the main body, a hard carbon film provided on the interlayer and a mixed layer formed within a thickness region of the interlayer and adjacent to an outer surface of the interlayer. The mixed layer is comprised of carbon and a constituent element of the interlayer and has a graded carbon content in its thickness direction so that a carbon content in a thickness portion closer to an outer surface of the mixed layer is higher than in a thickness portion remoter from the outer surface of the mixed layer.

In a preferred embodiment in accordance with the second aspect, the mixed layer is formed by introducing carbon into an interlayer region adjacent to the outer surface of the interlayer.

The interlayer may be formed of Si, Ti, Zr, Ge, Ru, Mo, W, or oxides, nitrides or carbides thereof, for example.

The member in accordance with the second aspect provides the hard carbon film on the sliding contact surface through the interlayer to exhibit a superior wear resistance. The formation of the interlayer between the hard carbon film and the main body provides an improved adhesion between the hard carbon film and the main body. Also, the formation of the mixed layer within the interlayer adjacent to its outer surface imparts a further improvement in the adhesion of the hard carbon film.

The term "present invention" will be hereinafter used to explain the matters common to the first and second aspects of the present invention.

In the present invention, the mixed layer is formed adjacent to the sliding contact surface of the main body or to the outer surface of the interlayer. The thickness of the mixed layer is preferably not less than 5 Å, more preferably in the range of 5 Å–1 $\mu$m, still more preferably in the range of 10 Å–200 Å. If the mixed layer is thinner, the expected improvement in adhesion may not result. If the thickness of the mixed layer exceeds 1 $\mu$m, the adhesion can not be necessarily improved in proportion to the thickness increment.

In the present invention, the mixed layer has a carbon content gradient in its thickness direction so that a carbon content in a thickness portion thereof adjacent or closer to its outer surface is higher than in a thickness portion thereof opposite to or remoter from its outer surface. The mixed layer has a concentrated portion having a maximum carbon content within the mixed layer. Such a concentrated portion is preferably present on the outer surface of the mixed layer or within a thickness region occupying 50% or less of a total thickness of the mixed layer from its outer surface. The carbon content in the concentrated portion of the mixed layer is preferably not smaller than 20 atomic percent, more preferably not smaller than 40 atomic percent.

As described above, it is preferable to form the mixed layer by introducing carbon into the region within the main body adjacent to its outer surface or into the region within the interlayer adjacent to its outer surface. Such an introduction of carbon can be effected by imparting a kinetic energy to active species of carbon such as carbon ions and allowing them to strike on the outer surface of either the main body or the interlayer. Specifically, the carbon introduction can be effected by allowing the carbon ions to strike on an outer surface of a substrate to which a negative self-bias voltage is being applied.

The hard carbon film in the present invention may comprise a diamond thin film, a film having a mixed diamond and amorphous structure, or an amorphous thin carbon film. The film having the mixed structure and the amorphous carbon film are those generally termed as diamond-like carbon films. The diamond-like carbon film generally contains hydrogen. The diamond-like film with a smaller hydrogen content exhibits an increased hardness and improved wear resistance. On the other hand, the diamond-like carbon film with a larger hydrogen content exhibits an reduced internal stress and improved adherence to an underlayer. It is accordingly preferred that the hard carbon film in accordance with the present invention has a hydrogen content gradient in its thickness direction so that a hydrogen content in a thickness portion thereof remoter from its outer surface is higher than in a thickness portion thereof closer to its outer surface. The provision of such a hydrogen content gradient imparts to the resulting hard carbon film the improved wear resistance and adherence to the underlayer. In the present invention, the hard carbon film may contain at least one additive element selected from the group consisting of Si, N, Ta, Cr, F and B. The inclusion of such an additive element results in a reduced friction coefficient and enhanced wear resistance of the hard carbon film. The inclusion of the additive element is preferably in the range of 3–60 atomic percent, more preferably in the range of 10–50 atomic percent. It is also preferred that the hard carbon film has a content gradient of the additive element in its thickness direction so that a content of the additive element in a thickness portion of the hard carbon film adjacent to its outer surface is higher than in a thickness portion thereof remoter from its outer surface. The provision of such a content gradient within the hard carbon film reduces the friction coefficient of the thickness portion adjacent to its outer surface and thereby enhances its wear resistance film more effectively.

The compressor of the present invention is characterized by employing the above-described member having a sliding contact surface of the present invention. In an exemplary case of a reciprocating compressor having a cylinder and a piston, the present invention is applicable to the cylinder having an inner peripheral surface for providing a sliding contact surface, and/or the piston having an outer peripheral surface for providing a sliding contact surface. In accordance with the first aspect, the hard carbon film is provided on the inner peripheral surface of the cylinder and the mixed layer is formed within the cylinder adjacent to its inner peripheral surface. The hard carbon film is also formed on the outer peripheral surface of the piston and the mixed layer is formed within the piston adjacent to its outer peripheral surface. In accordance with the second aspect, the interlayer is placed on the inner peripheral surface of the cylinder. The mixed layer is formed within the interlayer adjacent to its outer surface and the hard carbon film is provided on the interlayer. In case of the piston, the interlayer is placed on the outer peripheral surface of the piston. The mixed layer is formed within the interlayer adjacent to its outer surface and the hard carbon film is provided on the interlayer.

In one embodiment of the rotary compressor in accordance with the present invention, a vane constitutes a main body of the member of the present invention to define a sliding contact surface at its leading end or side portion. In the first aspect, a hard carbon film is provided at least on the leading end or side portion of the vane. A mixed layer is formed within the vane adjacent at least to an outer surface of the leading end or side portion of the vane. In the second aspect, an interlayer is provided at least on the leading end or side portion of the vane, and the hard carbon film is provided on the interlayer. The mixed layer is formed within the interlayer adjacent to its outer surface.

In another embodiment of the rotary compressor in accordance with the present invention, a roller constitutes a main body of the member of the present invention to define a sliding contact surface at its outer peripheral surface. In the first aspect, a hard carbon film is provided at least on the outer peripheral surface. A mixed layer is formed within the roller adjacent to its outer peripheral surface. In the second aspect, an interlayer is provided on the outer peripheral surface of the roller, and the hard carbon film is provided on the interlayer. A mixed layer is formed within the interlayer adjacent to its outer surface.

In still another embodiment of the rotary compressor in accordance with the present invention, a cylinder constitutes a main body of the member of the present invention to define a sliding contact surface at an inner surface of a cylinder channel. In the first aspect, a hard carbon film is provided on the inner surface of the cylinder channel. A mixed layer is formed within the cylinder wall adjacent to the inner surface of the cylinder channel. In the second aspect, an interlayer is provided on the inner surface of the cylinder channel, and the hard carbon film is provided on the interlayer. A mixed layer is formed within the interlayer adjacent to its outer surface.

The rotary compressor in accordance with a third aspect of the present invention includes a roller, a cylinder and a vane. A hard carbon film is formed on at least a leading end or side portion of the vane, an outer peripheral surface, or an inner surface of a cylinder channel.

In the third aspect, an interlayer may be formed between the hard carbon film and any of the vane, the outer peripheral surface of the roller and the inner surface of the cylinder channel. The types of the interlayer materials employed in the above second aspect may be applicable to the interlayer in the third aspect.

Again, in the third aspect, the hard carbon film may contain hydrogen. If that is the case, it is preferred that the hard carbon film has a hydrogen content gradient in its thickness direction so that a hydrogen content in a thickness portion thereof remoter from its outer surface is higher than in a thickness portion thereof closer to its outer surface.

Again, in the third aspect, the hard carbon film may contain at least one additive element selected from the group consisting of Si, N, Ta, Cr, F and B. It is preferred that the hard carbon film has a content gradient of the additive element in its thickness direction so that a content of the additive element in a thickness portion thereof adjacent to its outer surface is higher than in a thickness portion thereof remoter from its outer surface.

In the present invention, the material types of the main body of the member is not particularly specified and includes Fe-based alloys, cast irons (Mo—Ni—Cr cast irons), steels (high-speed tool steels), aluminum alloys, carbons (aluminum impregnated carbons), ceramics (oxides, nitrides and carbides of Ti, Al, Zr, Si, W, and Mo), Ni alloys, and stainless steels.

In accordance with the present invention, the hard carbon film having a high hardness can be formed on a substrate in a manner to be securedly adhered thereto. Therefore, the member of the present invention exhibits the improved wear resistance and can be steadily used for a prolonged period of time.

The compressors and rotary compressors incorporating such a member produces less sludges even after their prolonged drives so that they can be steadily employed for a prolonged period of time.

DESCRIPTION OF THE PREFERRED EMBODIMENTS

Figure 8:
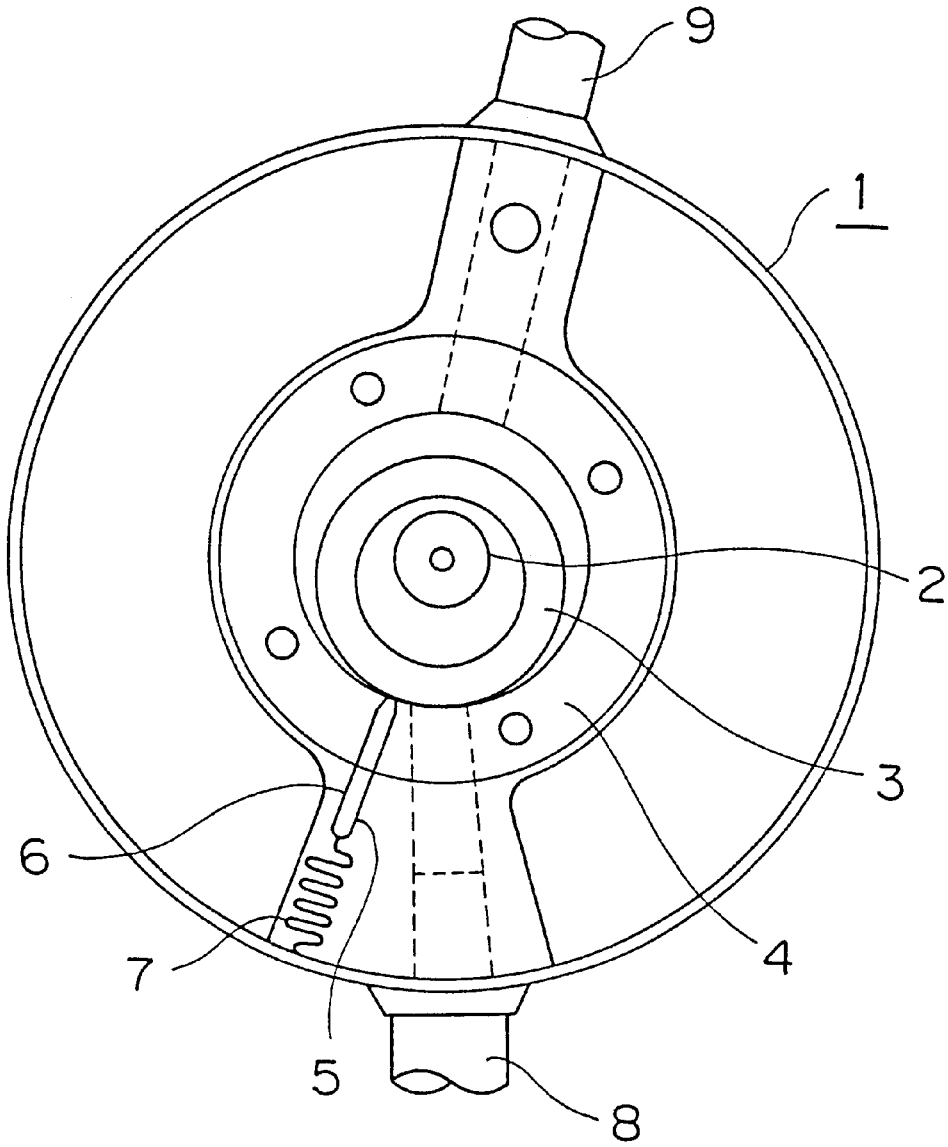
FIG. 8 is a schematic cross-sectional view showing a general structure of a rotary compressor.

FIG. 8 is a schematic cross-sectional view showing a general construction of a rotary compressor.

Referring to FIG. 8, the rotary compressor includes a closed container 1, a crank shaft 2 driven by an electric motor (not shown), a roller mounted eccentric to the crank shaft. The roller 3 is made of Mo—Ni—Cr cast iron.

A hollow cylinder 4 of cast iron is disposed to accommodate the roller 3 therein.

The hollow cylinder 4 has a channel 5 within which a vane 6, as hereinafter described, reciprocates. The vane 6 partitions a space interior of the hollow cylinder 4 into a high-pressure part and a low-pressure part. The vane 6 is made of high-speed tool steel (SKH51).

The vane 6 is urged against the roller 3 by a spring 7.

An inlet tube 8 is provided to supply a refrigerant carrier into the interior of the hollow cylinder 4. The refrigerant carrier pressurized and heated within the hollow cylinder 4 is exhausted through an exhaust tube 9.

The operation of the rotary compressor as constructed in the manner as described above will be now explained.

When the electric motor drives the crank shaft 2, the roller 3 mounted eccentric to the crank shaft 2 moves circumferentially along an inner surface of the hollow cylinder 4 while rotating. Since the vane 6 is urged against the roller 3 by both a pressurized gas and the spring 7, the vane 6 is constantly brought into contact with a periphery of the roller 3. Accordingly, a rotational motion of the roller 3 is translated into a reciprocating motion of the vane 6 within the cylinder channel 5.

As such a reciprocating motion is continued, the refrigerant carrier is suctioned through the inlet tube 8 into the interior of the hollow cylinder 4 within which it is compressed to increase its temperature and pressure before discharged through the exhaust tube 9 to outside of the rotary compressor.

Figure 1:
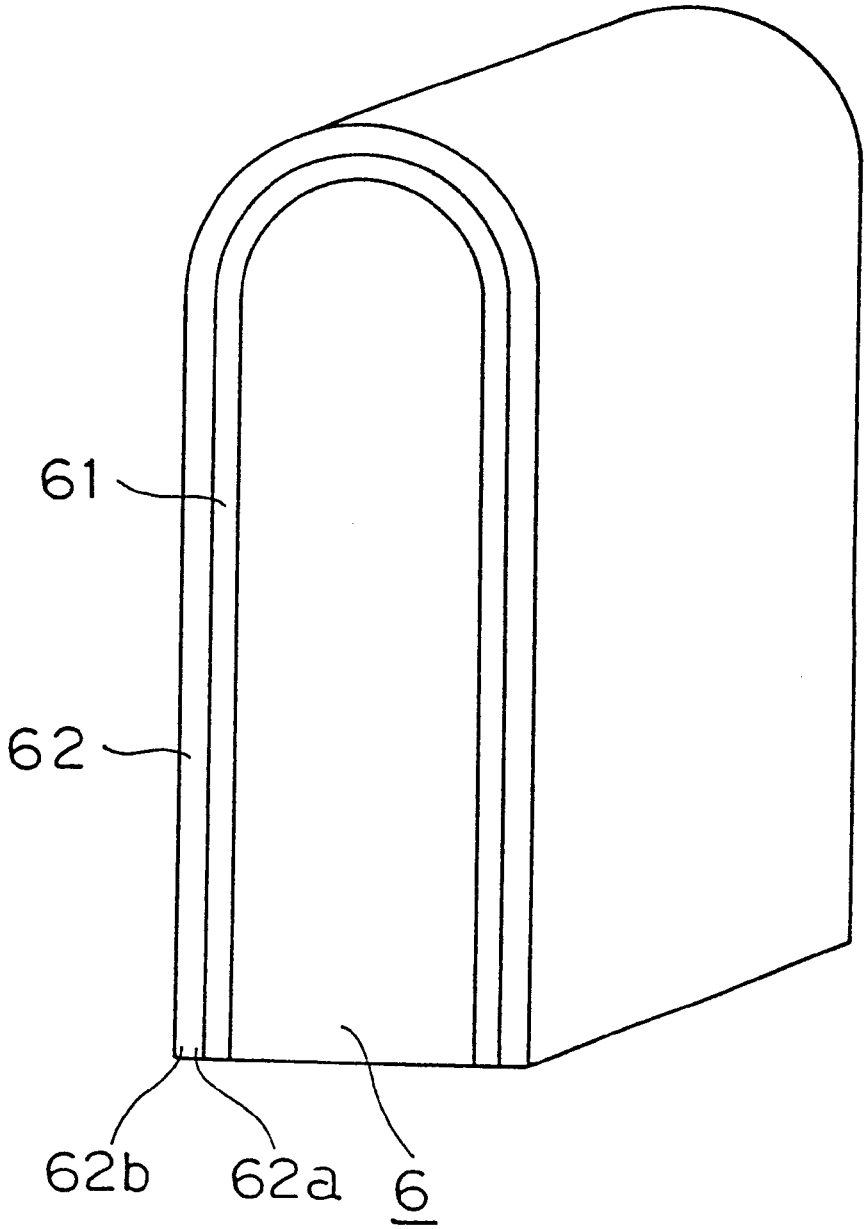
FIG. 1 is a schematic cross-sectional view showing one embodiment in accordance with a third aspect of the present invention.

FIG. 1 is a schematic cross-sectional view of the vane 6 carrying a hard carbon coating film thereon, which can be employed for the rotary compressor of the present invention.

In practicing the present invention, the hard carbon film may be in the form of a diamond thin film, a thin film having a mixed diamond and amorphous carbon structure, or an amorphous carbon thin film.

The interlayer may be formed of Si, Ti, Zr, Ge, Ru, Mo, W, or, oxides, nitrides or carbides thereof.

In the embodiment as shown in FIG. 1, an interlayer 61 of Si is formed on the vane 6. A hard carbon film 62 is formed on the interlayer 61 to define an interface therebetween. The hard carbon film 62 has a composition for better adherence onto the vane 6.

More preferably, the hard carbon film 62 may have a graded composition such that a hydrogen content therein decreases continuously from a portion 62*a* adjacent to the interface to an outer surface of a film layer 62*b*.

Since the hydrogen content is higher toward the portion 62*a* adjacent to the interface, a thickness portion of the hard carbon film 62 adjacent or closer to the interlayer 61 has reduced internal stress and hardness. This serves to prevent the hard carbon film 62 from delaminating from the interlayer 61.

Although the hydrogen content is above described to be continuously varied in a thickness direction of the hard carbon film 62, such a hydrogen content gradient may be rendered stepwise by providing a hydrogen-richer layer(s) and a hydrogen-poorer layer(s) in the hard carbon film 62.

Figure 2:
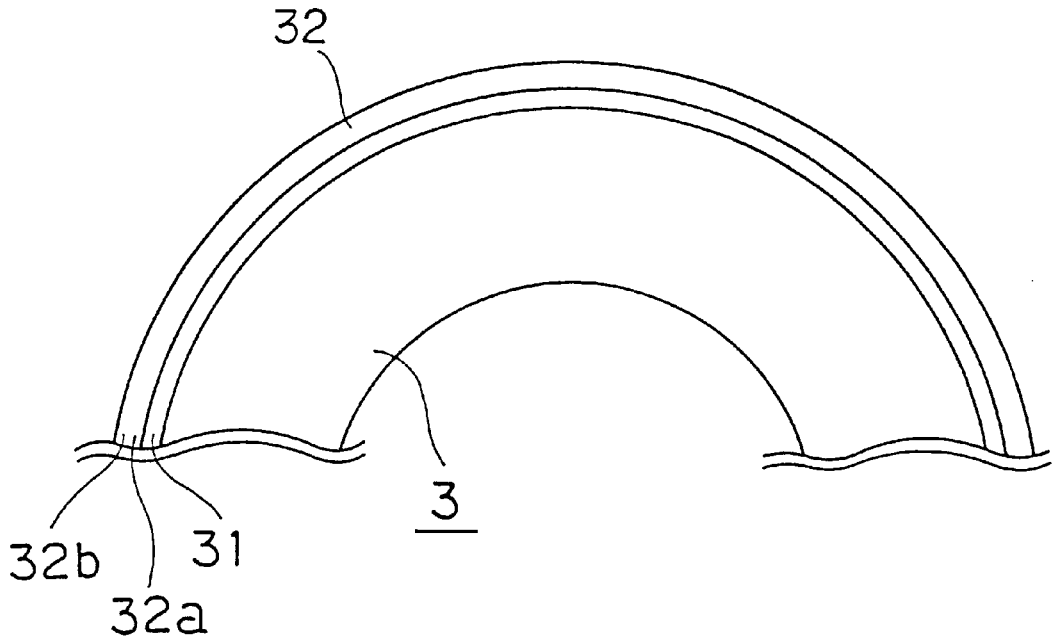
FIG. 2 is a schematic cross-sectional view showing another embodiment in accordance with the third aspect of the present invention.

FIG. 2 is a schematic cross-sectional view of the roller 3 carrying thereon a hard carbon film, which can be employed for the rotary compressor of the present invention.

FIG. 2 also shows one applicable form of the hard carbon film in accordance with the present invention.

In the embodiment as shown in FIG. 2, formed on the roller 3 is an interlayer 31 of Si. A hard carbon film 32 is formed on the Si interlayer 31 to define an interface therebetween. The hard carbon film 32 has a composition for better adherence to the roller 3.

More preferably, the hard carbon film 32 may have a graded composition such that a hydrogen content therein decreases continuously from a portion 32*a* adjacent to the interface to a film layer 32*b*.

Since the hydrogen content is higher toward the portion 32*a* adjacent to the interface, a thickness portion of the hard carbon film 32 closer to the interlayer 31 has reduced internal stress and hardness. This serves to prevent the hard carbon film 32 from delaminating from the interlayer 31.

Although the hydrogen content is above described to be continuously varied in a thickness direction of the hard carbon film 32, such a hydrogen content gradient may be rendered stepwise by providing a hydrogen-richer layer(s) and a hydrogen-poorer layer(s) in the hard carbon film 32.

Figure 3:
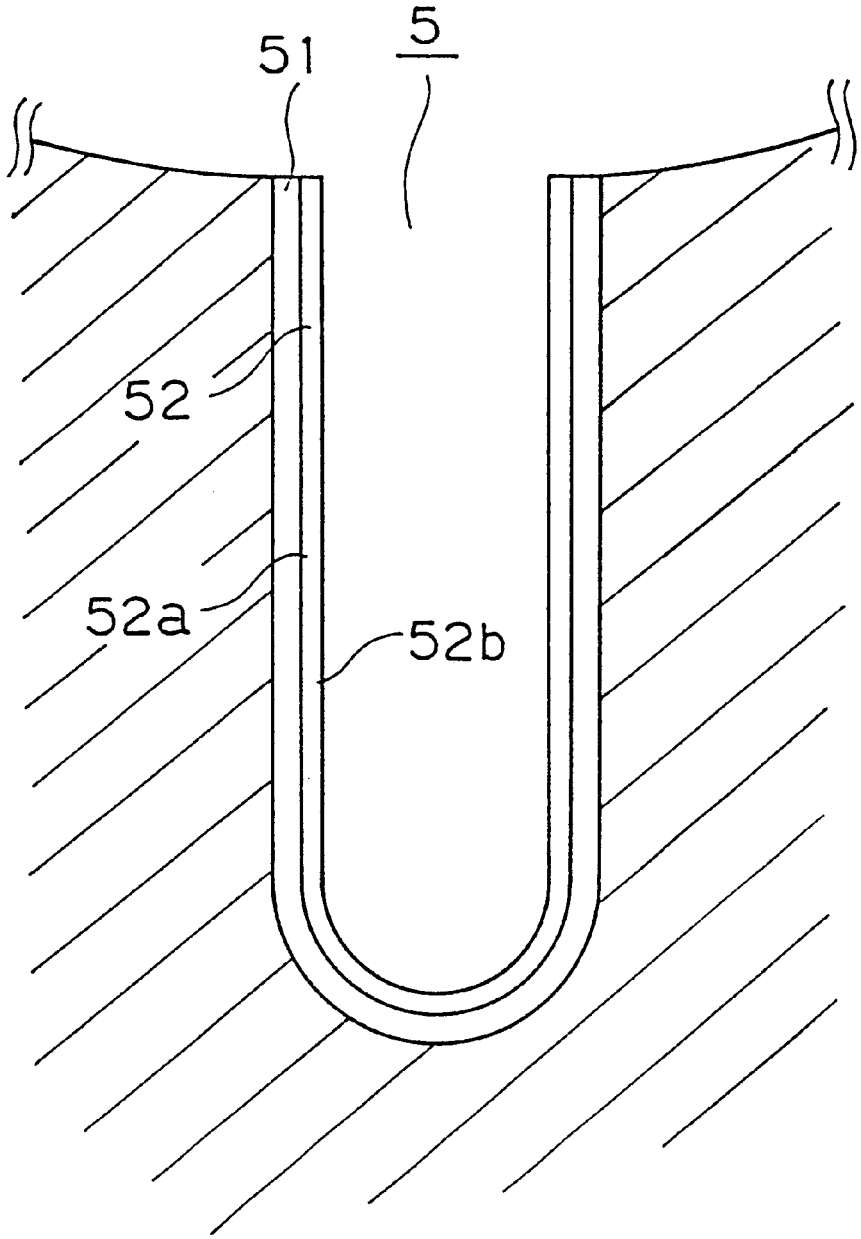
FIG. 3 is a schematic cross-sectional view showing still another embodiment in accordance with the third aspect of the present invention.

FIG. 3 is an enlarged cross-sectional view of the cylinder channel 5 carrying thereon a hard carbon film, which can be employed for the rotary compressor of the present invention.

FIG. 3 also shows another applicable form of the hard carbon film in accordance with the present invention.

In the embodiment shown in FIG. 3, formed on an inner surface of a cylinder channel 5 is an interlayer 51 consisting of Si. A hard carbon film 52 is formed on the interlayer 51 to define an interface therebetween. The hard carbon film 52 has a composition for better adherence to the inner surface of the cylinder channel 5.

More preferably, the hard carbon film 52 may have a graded composition such that a hydrogen content therein is continuously reduced from a portion 52*a* adjacent to the interface to a film layer 52*b*.

Since the hydrogen content is higher toward the portion 52*a* adjacent to the interface, a thickness portion of the hard carbon film 52 closer to the interlayer 51 has reduced internal stress and hardness. This serves to prevent the hard carbon film 52 from delaminating from the interlayer 51.

Although the hydrogen content is above described to be continuously varied in a thickness direction of the hard carbon film 52, such a hydrogen content gradient may be rendered stepwise by providing a hydrogen-richer layer(s) and a hydrogen-poorer layer(s) in the hard carbon film 52.

Figure 4:
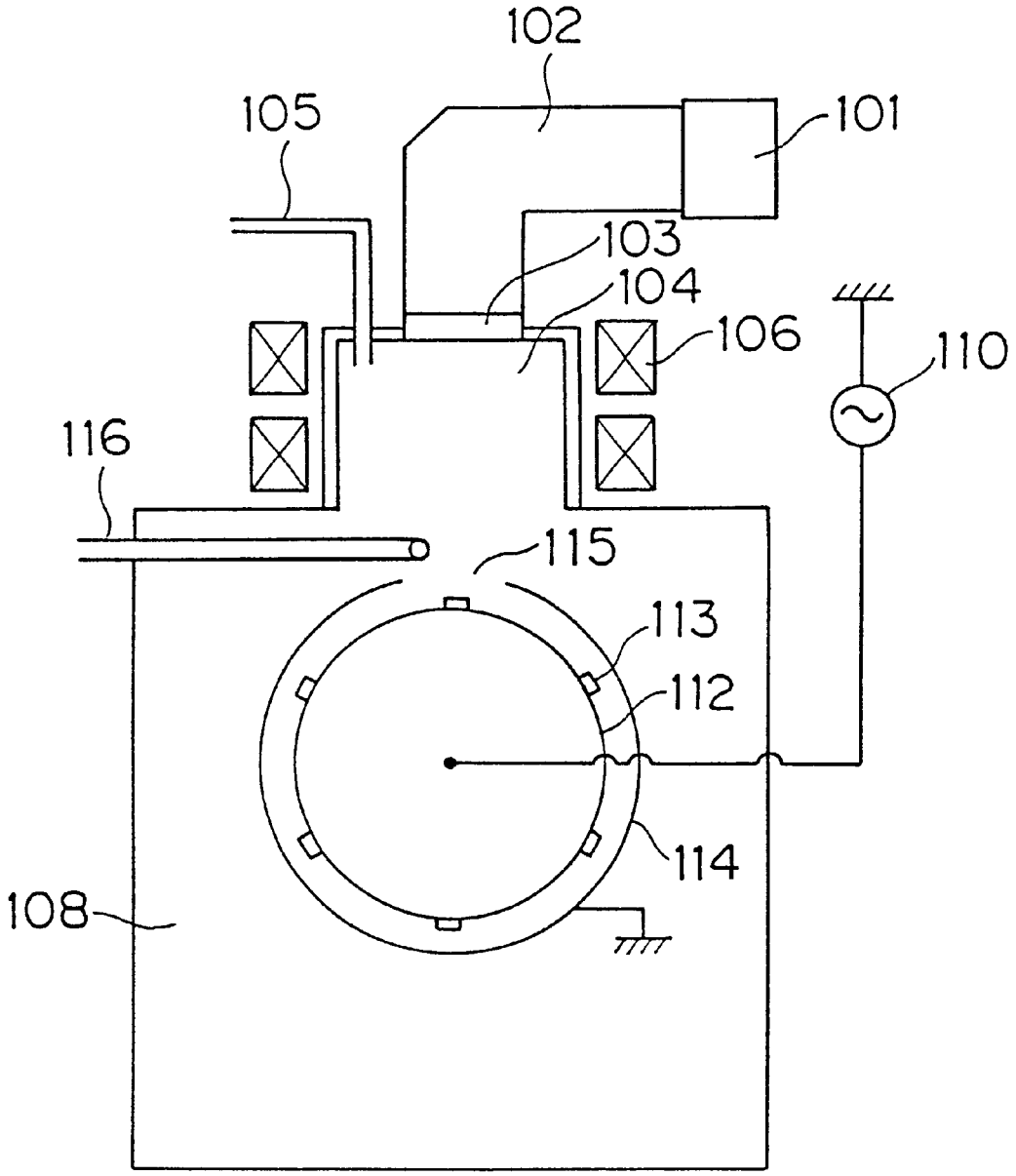
FIG. 4 is a schematic cross-sectional view of an exemplary ECR plasma CVD apparatus as employed in the embodiments in accordance with the present invention.

FIG. 4 is a schematic diagram of an exemplary ECR plasma CVD apparatus which can be employed to form the hard carbon film in the present invention.

Referring to FIG. 4, disposed interior of a vacuum chamber 108 are a plasma generation chamber 104 and a reaction chamber within which substrates, such as vanes 113 are positioned. One end of a waveguide 102 is connected to the plasma generation chamber 104. Another end of the waveguide 102 is mounted to a microwave supplying means 101.

The microwaves generated within the microwave supplying means 101 pass through the waveguide 102 and a microwave inlet window 103 to be guided into the plasma generation chamber 104.

Connected to the plasma generation chamber 104 is a discharge gas inlet line 105 for introducing a discharge gas such as argon (Ar) into the plasma generation chamber 104. A plurality of plasma magnetic field generators 106 are mounted circumferentially of the plasma generation chamber 104.

A drum-shaped vane holder 112 is provided within the reaction chamber in the vacuum chamber 108 so as to be rotatable about an axis which perpendicularly crosses a page surface of the drawing. A motor (not shown) is connected to the vane holder 112.

A plurality of vanes 113 (twenty four in this embodiment) are arranged circumferentially of the vane holder 112 at regular intervals. A high-frequency power source 110 is connected to the vane holder 112. A hollow cylindrical shielding cover 114, made of metal, radially surrounds the vane holder 112 to define therebetween a spacing of about 5 mm. The shielding cover 114 is connected to a grounded electrode. The shielding cover 114 functions to prevent generation of discharges between the vacuum chamber 108 and a vane holder area excluding target film-forming locations thereon, which discharges will be otherwise generated when a radio frequency (RF) voltage is applied to the vane holder 112 for film formation.

The shielding cover 114 has an opening 115. A plasma from the plasma generation chamber 104 is directed to pass through the opening 115 to impact the vanes 112 mounted on the vane holder 112. The vacuum chamber 108 is equipped with a reaction gas inlet line 116. A leading end of the reaction gas inlet line 116 is positioned above the opening 115.

In the case where the hard carbon film 32 is formed on the peripheral surface of the roller 3, a drum-shaped holder may not be employed. Then, the roller 3 is connected to the high-frequency power source 110. The shielding cover 114 is configured to be spaced about 5 mm from the roller 3 and is connected to the grounded electrode.

The aforementioned film forming apparatus may be employed to form the hard carbon film of the embodiment shown in FIG. 1 in the following exemplary procedures.

The vacuum chamber 108 is first evacuated to a pressure of $10^{-5}$–$10^{-7}$ Torr., followed by rotation of the vane holder 112 at a speed of about 10 rpm. The Ar gas at $5.7\times10^{-4}$ torr. is then supplied from the discharge gas inlet line 105 while a 2.45 GHz, 100 W microwave is supplied from the microwave supplying means 101, so that an Ar plasma is generated within the plasma generation chamber 104 to strike a surface of each vane 6.

Figure 5:
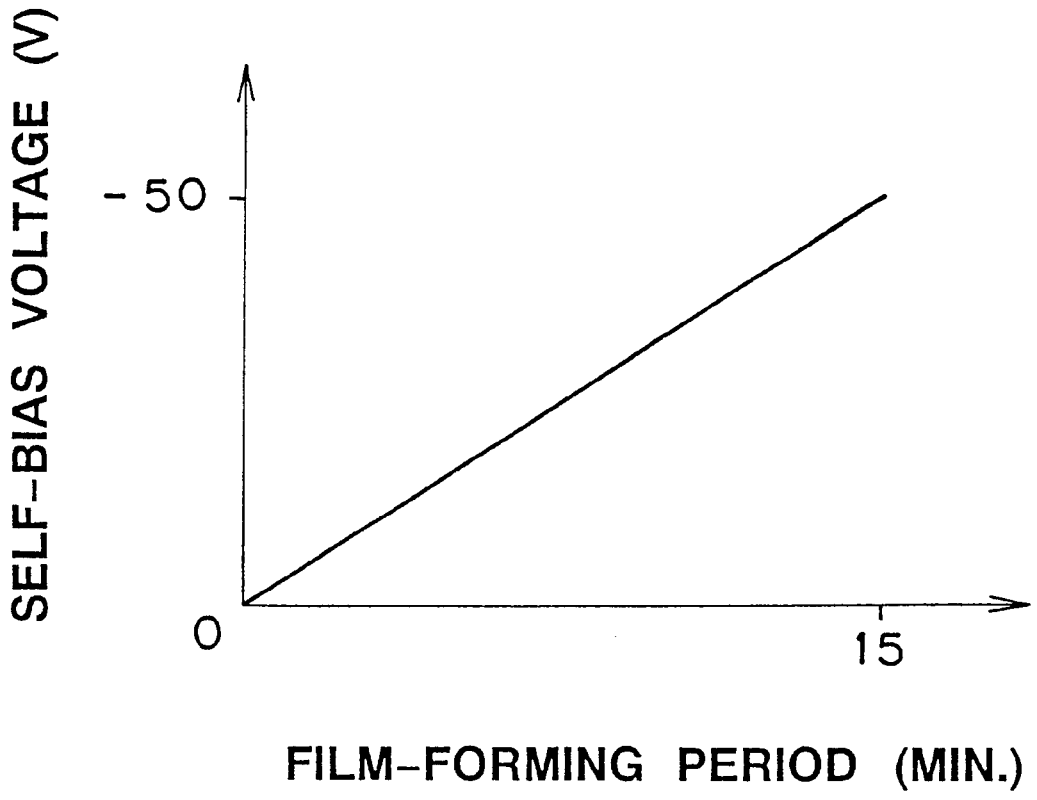
FIG. 5 is a graph showing the relation between the film-forming period and the self-bias voltage in the embodiments in accordance with the present invention.

Simultaneously with the above, a $CH_4$ gas at $1.3\times10^{-3}$ Torr. is supplied through the reaction gas inlet line 116 while a 13.56 MHz RF power from the high-frequency power source 116 is supplied to the vane holder 112. Here, the RF power is supplied to the vane holder 112 in a controlled fashion so that a self-bias voltage generated in each of the vanes 113 is varied through a range from 0 V at the start of the film-forming to −50 V at completion of the film-forming (in 15 minutes after the start), as shown in FIG. 5.

The hard carbon film of 5000 Å thick was formed on each of the vanes 6 in accordance with the aforementioned procedures.

Figure 6:
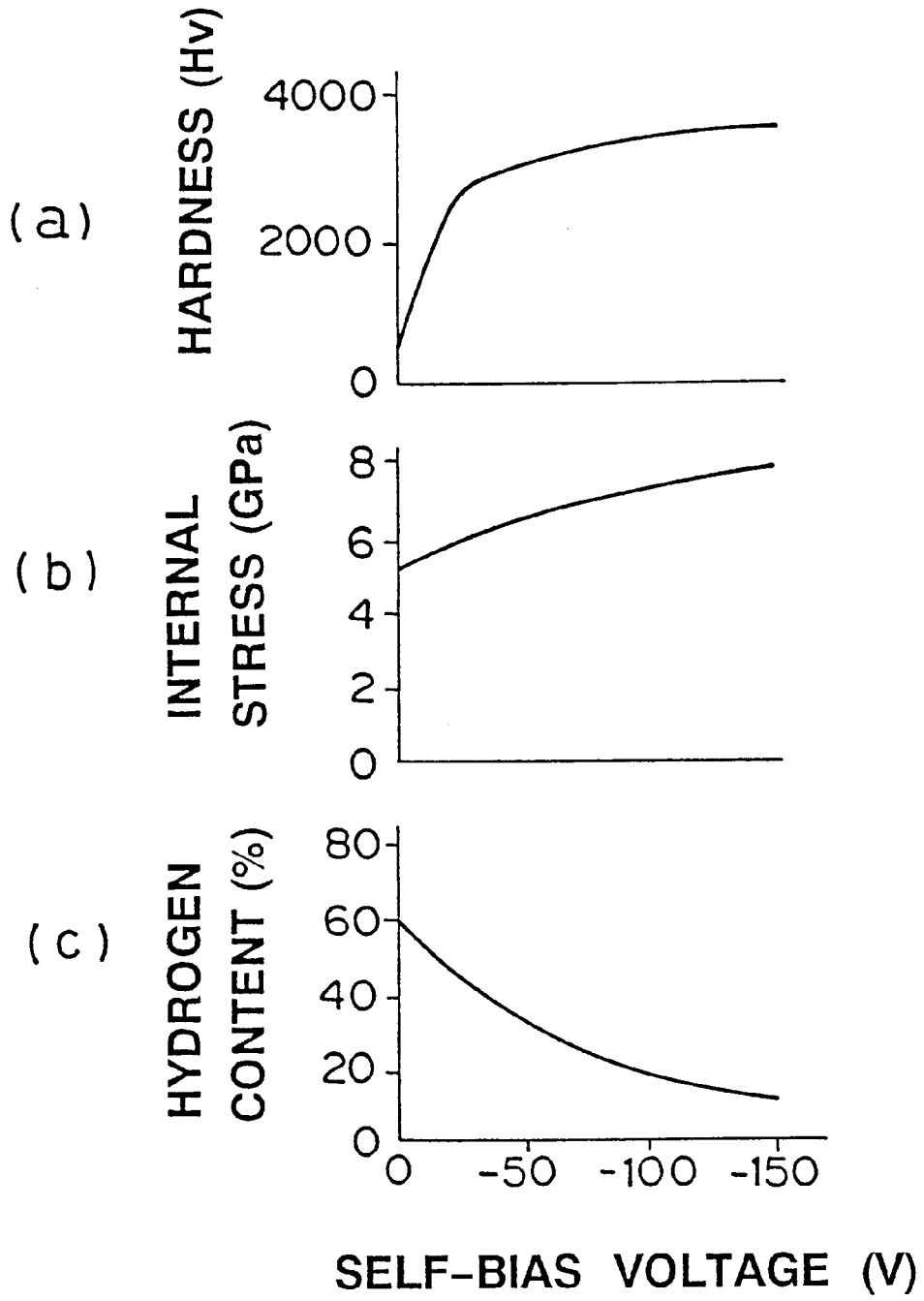
FIGS. 6(*a*) through 6(*c*) are graphs showing the relations of the self-bias voltage respectively to the hardness, internal stress and hydrogen content.

FIG. 6 are graphs showing the relations of the self-bias voltages produced in the vane holder respectively to the hardnesses, internal stresses and hydrogen contents of the hard carbon films formed at those self-bias voltages.

In operating the aforementioned film-forming apparatus of FIG. 4, a specific self-bias voltage produced in the vane holder was maintained constant to form a hard carbon film at the specific self-bias voltage. The hard carbon film thus obtained was measured for its properties including hardness, internal stress and hydrogen content. The measured values are given in FIG. 6.

As can be seen from FIG. 6, the self-bias voltage of 0 V results in the formation of a hard carbon film having a Vickers hardness of about 800 Hv, an internal stress of about 5 GPa, and a hydrogen content of about 60 atomic percent.

On the other hand, the self-bias voltage of −50 V results in the formation of a hard carbon film having a Vickers hardness of about 3000 Hv, an internal stress of about 6.5 GPa, and a hydrogen content of about 35 atomic percent.

It is believed that the changes in the respective properties as shown in FIG. 6 have been reflected in a thickness direction of the above embodiment of the hard carbon film formed at varied self-bias voltages from 0 to −50 V.

Therefore, the portion 62*a* of the hard carbon film 62 adjacent to the interface has lower hardness and internal stress to exhibit better adherence to the interlayer, and accordingly to the vane 6.

On the other hand, the film layer 62*b* has a higher hardness to provide an adequate surface hardness as demanded for the hard carbon films.

Figure 7:
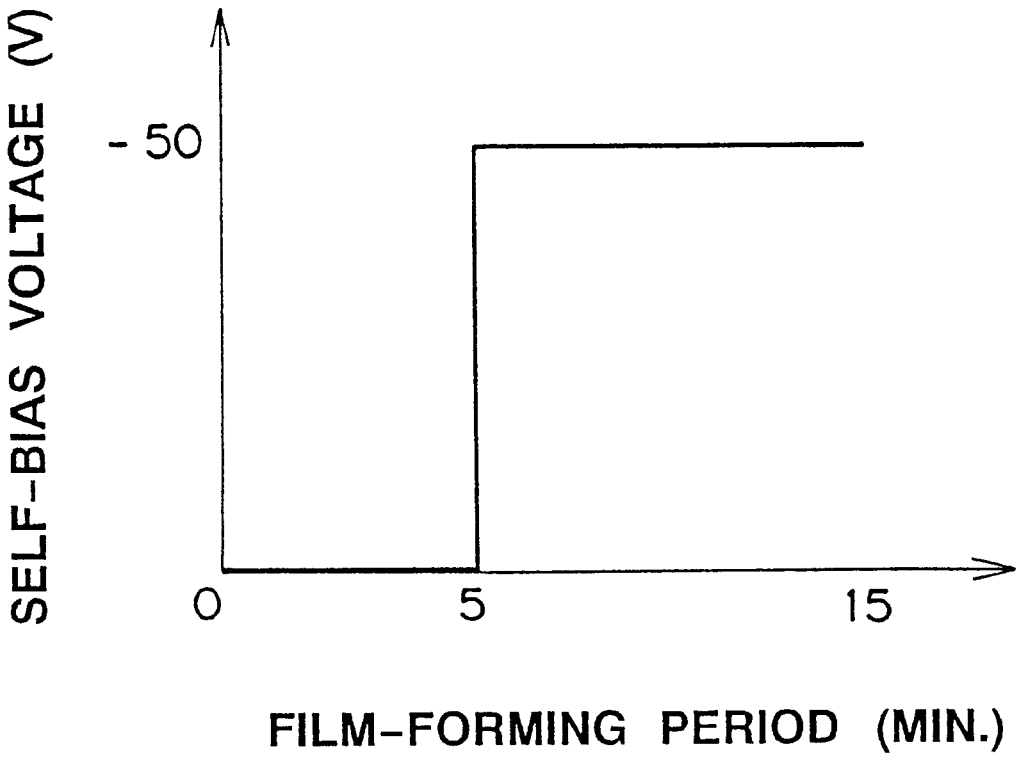
FIG. 7 is a graph showing the relation between the film-forming period and the self-bias voltage in the embodiments in accordance with the present invention.

The hard carbon film 62 was formed in the same manner as in the above embodiment, with the exception that the self-bias voltage was maintained at 0 V during a first 5-minute period from the start of film formation and at −50 V during a subsequent 10-minute period that completed in 15 minutes from the start, as shown in FIG. 7. The resulting hard carbon film formed on the vane 6 had a film thickness of 5000 Å and a Vickers hardness of 3000 Hv.

For comparative purposes, a hard carbon film was formed in the same manner as in the above embodiment, with the exception that the self-bias voltage produced in the vane holder was maintained at 0 V during the film formation. The resulting hard carbon film formed on the vane 6 had a film thickness of 5000 Å and a Vickers hardness of 800 Hv.

The hard carbon film was tested for adherence. In evaluating the adherence, a constant load (1 kg) indentation test was conducted using a Vickers penetrator. For evaluating the adherence of differently formed hard carbon films, fifty samples were prepared for each and the number of samples which showed the delamination of the hard carbon film 62 from the vane 6 was counted as indicating the level of the adherence thereof. Those hard carbon films subjected to such an evaluation included a hard carbon film which was formed at the varied self-bias voltages from 0 V to −50 V upon the Si interlayer 61 (100 Å thick) previously formed upon the vane 6, another hard carbon film which omitted the Si interlayer 61 to form directly upon the vane 6 at a constant self-bias voltage of −50 V maintained after the lapse of five minutes from the start of film formation till the completion of film formation, and another hard carbon film which was formed on the Si interlayer 61 at a constant self-bias voltage of −50 V maintained after the lapse of five minutes from the start of film formation till the completion of film formation. The evaluation results are shown in Table 1.

TABLE 1

| Si Interlayer | Self-Bias Voltage (V) | Number of Samples Experienced Delamination |
|---|---|---|
| Absent | −50 | 45 |
| Present | −50 | 5 |
| | 0—50 | 0 |

As can be seen from Table 1, in the case where the Si interlayer 61 was not formed on the vane 6, i.e., the hard carbon film 62 was directly formed on the vane 6, forty five samples thereof were found to delaminate from the vane 6 even though formed at the self-bias voltage of −50 V. On the other hand, in the case where the Si interlayer 61 was formed on the vane 6, i.e., the hard carbon film 62 was formed on the interlayer 61 at the constant self-bias voltage of −50 V, only five samples thereof were observed to delaminate from the interlayer 61.

Furthermore, in the case where the Si interlayer 61 was formed on the vane 6, i.e., the hard carbon film 62 was formed on the Si interlayer 61 at the varied self-bias voltages from 0 V to −50 V, no sample thereof showed delamination.

The above results demonstrate that the hard carbon film for use in the present invention has improved hardness and adherence sufficient to impart a wear-resistance to sliding contact surfaces of various members such as of the vane 6, roller 3 and cylinder channel 5. Such a hard carbon film coating serves to reduce sludge production at the sliding contact surfaces of those members.

In the above embodiments, the ECR plasma CVD apparatus is employed to form the hard carbon film. However, it is to be understood that this is not intended to exclude the use of the other suitable techniques for the film formation.

As will be appreciated from the above descriptions, the present invention provides a vane, roller or cylinder channel on which a hard carbon film is formed to impart thereto adequate hardness and chemical stability. Since the hard carbon film can be well adhered to the vane, roller or cylinder channel, a rotary compressor incorporating such components can be operated for a prolonged period of time without producing an appreciable amount of sludge. This prevents the occurrence of its blocking the supply of refrigerant carrier through a capillary tube and performs a protective effect by which a critical damage to the rotary compressor can be avoided.

Figure 9:
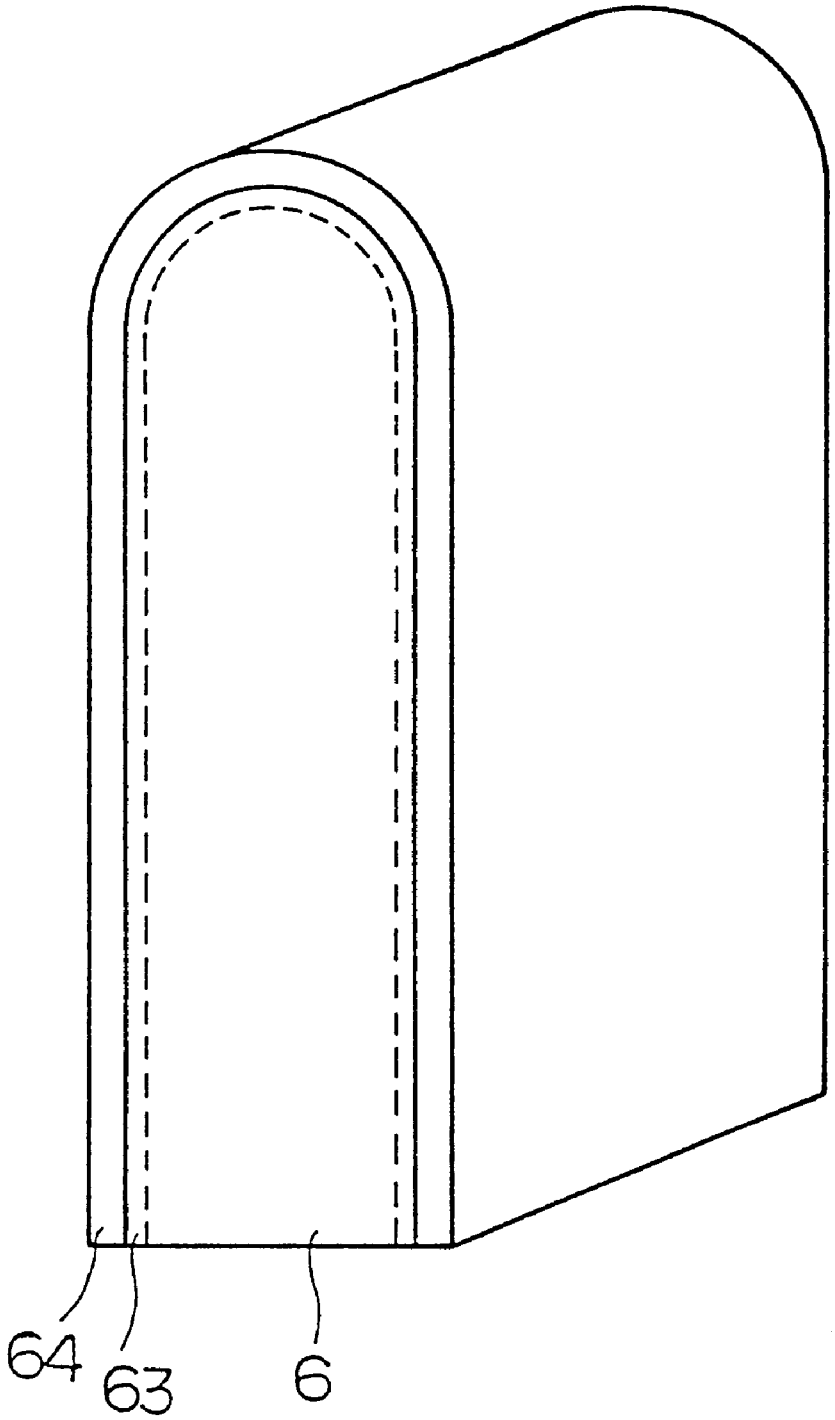
FIG. 9 is a schematic cross-sectional view showing one embodiment in accordance with a first aspect of the present invention.

FIG. 9 is schematic perspective view showing one embodiment in accordance with a first aspect of the present invention. A hard carbon film 64 is formed on a main body of a member in accordance with the present invention, i.e. a vane 6 to define an interface therebetween. A mixed layer 63 is formed in a thickness region of the vane 6 adjacent to the interface.

Figure 10:
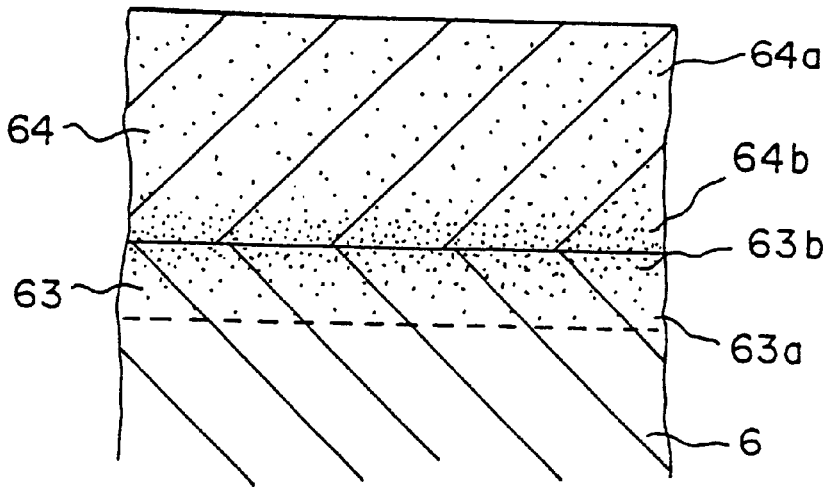
FIG. 10 is an enlarged cross-sectional view showing a vane of the embodiment shown in FIG. 9 and its vicinities.

FIG. 10 is an enlarged schematic cross-sectional view showing the vane 6 of FIG. 9 and its vicinities. As illustrated in FIG. 10, the mixed layer 63 is formed in the thickness region of the vane 6 adjacent to the interface. The mixed layer 63 is formed of carbon and an constituent element of the vane 6, e.g. Fe. A carbon content in a thickness portion 63*b* of the mixed layer 63 closer to the interface is made higher than in a thickness portion 63*a* of the mixed layer 63 remoter from the interface to define a carbon content gradient in a thickness direction of the mixed layer 63. Such a mixed layer 63 can be formed by introducing carbon into the thickness region of the vane 6 adjacent to the interface. The introduction of carbon can be accomplished, for example, by operating the above-described ECR plasma CVD apparatus to cause the vane 6 to produce a negative self-bias voltage at an early stage of film formation.

The hard carbon film 64, such as a diamond-like carbon film is formed on the mixed layer 63. Preferably, the hard carbon film has a hydrogen content gradient in its thickness direction so that a hydrogen content in a thickness portion 64*b* thereof remoter from an outer surface of the hard carbon film is higher than in a thickness portion 64*a* thereof closer to the outer surface of the hard carbon film.

The thickness of the mixed layer 63 is preferably not less than 5 Å, more preferably in the range of 10–200 Å.

Figure 11:
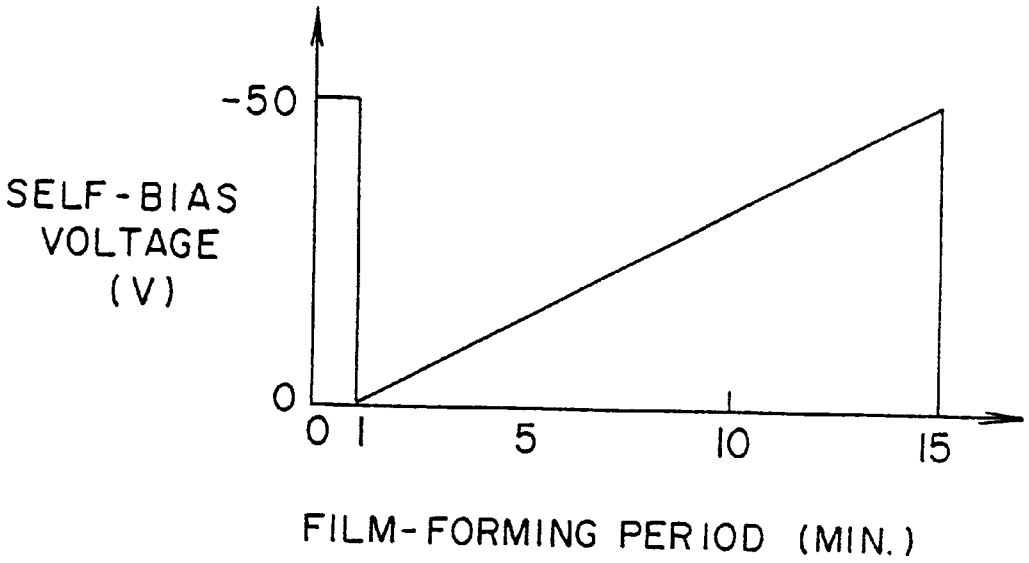
FIG. 11 is a graph showing the relation between the film-forming period and the self-bias voltage in the embodiments in accordance with the present invention.

The apparatus of FIG. 4 was employed to form a hard carbon film. The self-bias voltage produced in the vane was maintained at −50 V during a first one-minute period from the start of the film formation. As shown in FIG. 11, the self-bias voltage was subsequently dropped to 0 V and varied immediately thereafter such that it increased gradually from 0 V to reach −50 V at the completion of film formation. During the first one-minute period when the self-bias voltage was maintained at −50 V, the mixed layer is formed within the vane adjacent to an outer surface of the vane. As a result, the hard carbon film was formed on the vane which had a thickness of 5000 Å and a Vickers hardness of 3000 Hv.

The hard carbon film thus formed was subjected to a scratch test for adherence evaluation. A diamond stylus was employed to conduct the test at a scratching speed of 100 mm/min. The maximum load was 500 g. Fifty samples of hard carbon film were tested, and the number of samples which showed delamination was counted as being indicative of a level of adherence of the hard carbon film. No sample was observed to experience delamination.

For comparative purposes, a RF power is applied so that the self-bias voltage produced in the vane was varied from 0 V at the start of film formation to −50 V at the completion of film formation when 15 minutes passed from the start, as shown in FIG. 5. The comparative hard carbon film thus formed revealed a thickness of 5000 Å and a Vickers hardness of 3000 Hv. The number of samples which experienced delamination was ten out of fifty.

As will be recognized from the above results, the adherence of the hard carbon film to a substrate, such as the vane, can be enhanced by forming an effective thickness of mixed layer in the surface layer of the substrate.

Figure 12:
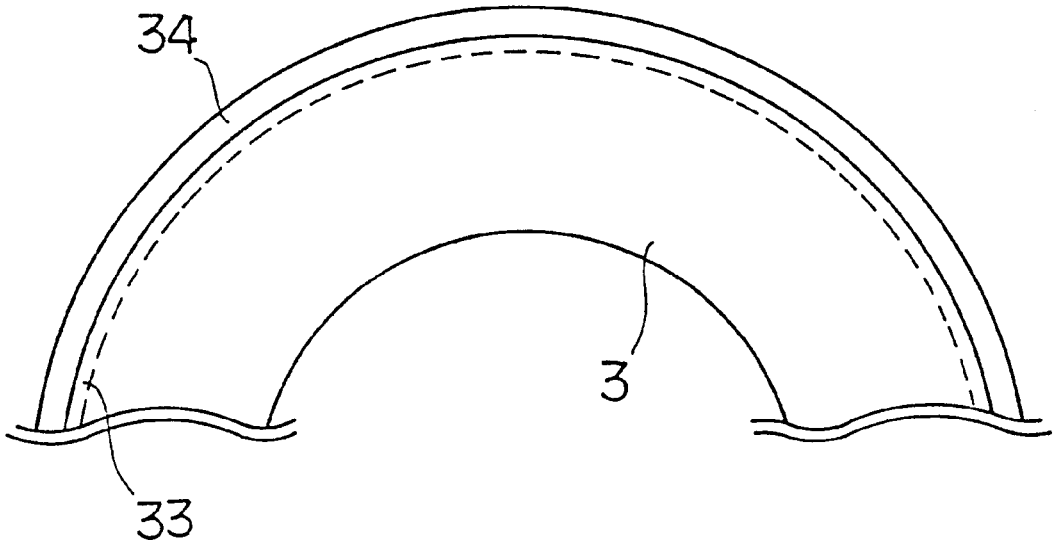
FIG. 12 is a schematic cross-sectional view showing another embodiment in accordance with the first aspect of the present invention.

FIG. 12 is a schematic cross-sectional view showing another embodiment in accordance with the first aspect of the present invention. A mixed layer 33 is formed within a roller 3 adjacent to an outer surface of the roller 3. Again, a carbon content in a thickness portion of the mixed layer 33 closer to its outer surface is higher than in a thickness portion remoter from its outer surface to define a carbon content gradient in the thickness direction of the mixed layer 33, as analogous to the embodiment shown in FIG. 11. The mixed layer 33 can be formed in the same manner as in the embodiment of FIG. 11. A hard carbon film 34 is formed upon the mixed layer 33.

The formation of the mixed layer 33 adjacent to an outer surface of the roller 3 results in improved adherence of the hard carbon film 34 to the roller 3.

Figure 13:
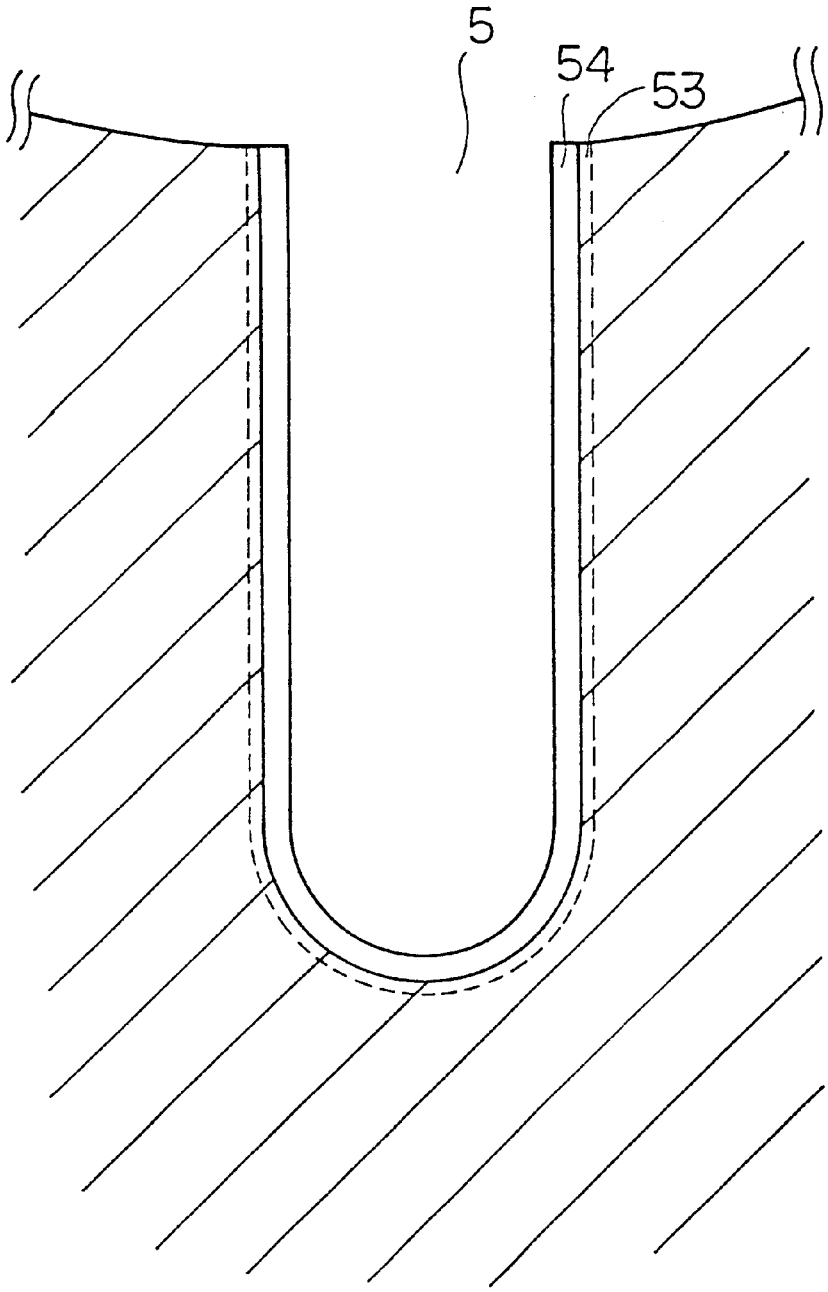
FIG. 13 is a schematic cross-sectional view showing still another embodiment in accordance with the first aspect of the present invention.

FIG. 13 is a schematic cross-sectional view showing still another embodiment in accordance with the first aspect of the present invention. A mixed layer 53 is formed in an inner wall of a cylinder channel 5 adjacent to an inner surface of the cylinder channel. As analogous to the embodiment shown in FIG. 11, the mixed layer 53 has a carbon content gradient in its thickness direction such that a carbon content in a thickness portion of the mixed layer 53 closer to its outer surface is higher than in a thickness portion of the mixed layer 53 remoter from its outer surface. The mixed layer 53 can be formed in the same manner as in the embodiment of FIG. 11. A hard carbon film 54 is formed on the mixed layer 53.

The formation of the mixed layer 53 adjacent to the inner surface of the cylinder channel 5 results in improved adherence of the hard carbon film 34 to the inner surface of the cylinder channel 5.

Figure 14:
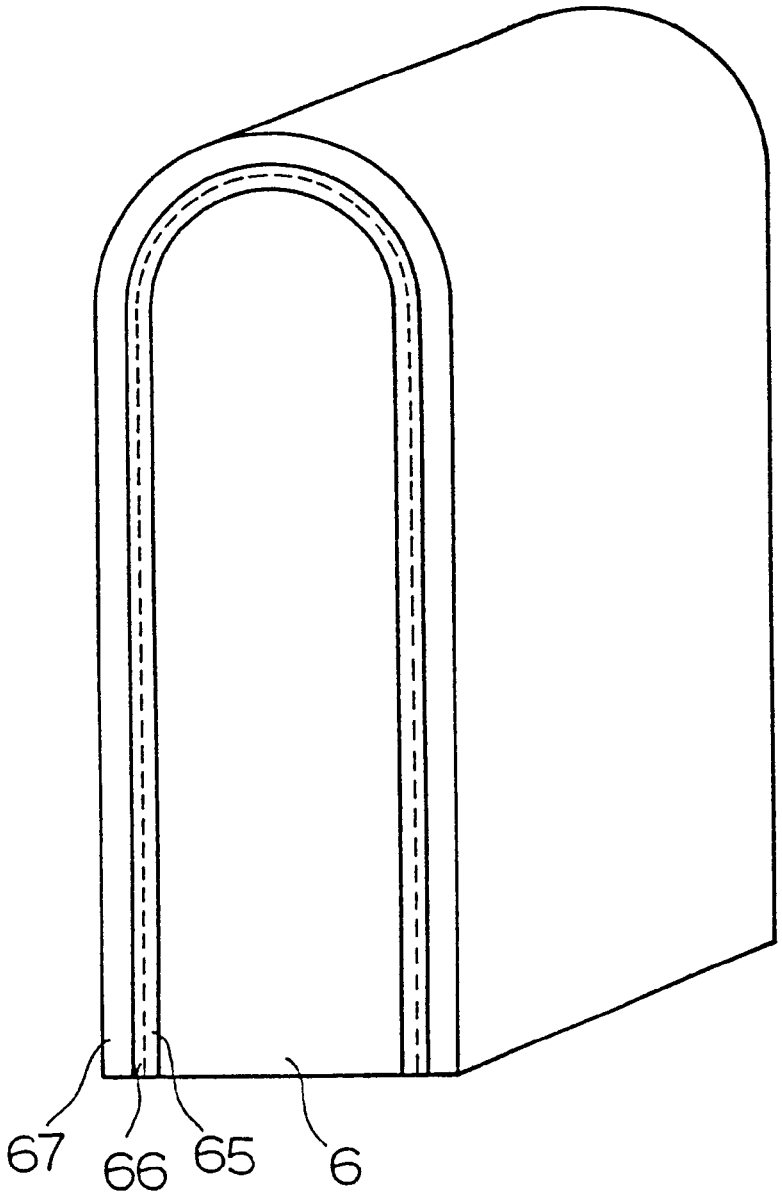
FIG. 14 is a schematic cross-sectional view showing one embodiment in accordance with a second aspect of the present invention.

FIG. 14 is a partly sectioned, schematic perspective view showing an embodiment in accordance with the second aspect of the present invention. Formed upon a vane 6 is an interlayer 65. A mixed layer 66 is formed within the interlayer 65 adjacent to an outer surface of the interlayer 65. The mixed layer 66 is formed of carbon and a constituent element of the interlayer 65. A hard carbon film 67 is formed upon the interlayer 65.

Figure 15:
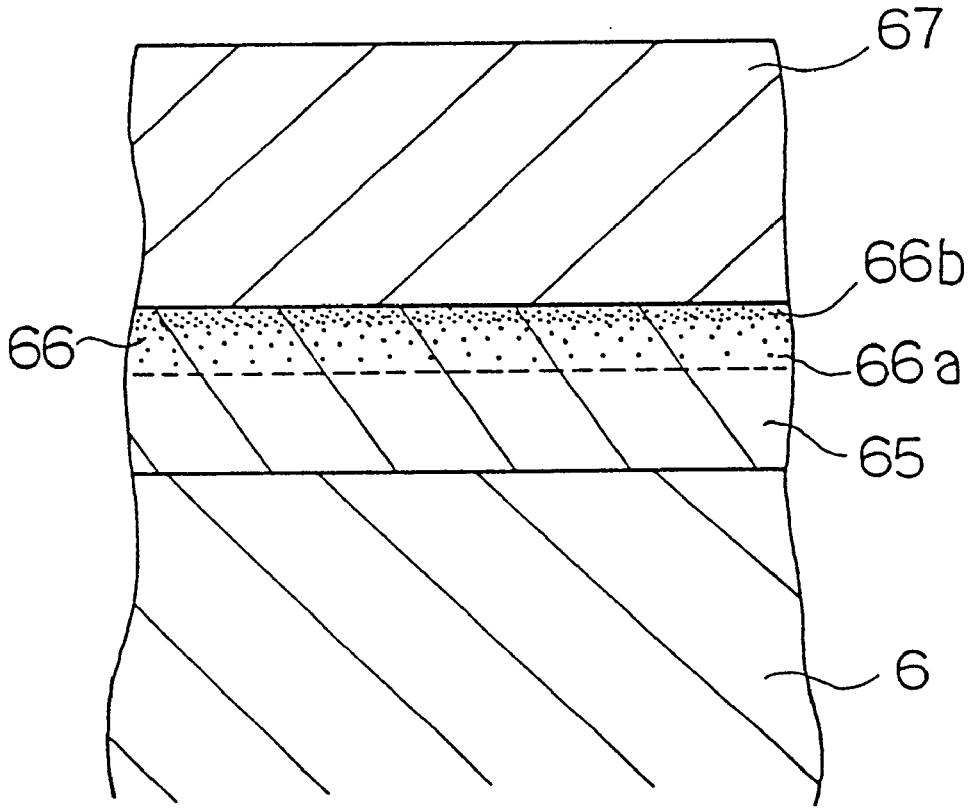
FIG. 15 is an enlarged cross-sectional view showing a vane of the embodiment shown in FIG. 14 and its vicinities.

FIG. 15 is an enlarged schematic cross-sectional view showing the vane 6 of FIG. 14 and its vicinities. As illustrated in FIG. 15, the mixed layer 66 has a carbon content gradient in its thickness direction such that a carbon content in a thickness portion 66*b* of the mixed layer 66 closer to the outer surface of the mixed layer 66 is higher than in a thickness portion 66*a* of the mixed layer 66 remoter from the outer surface of the mixed layer 66. Such a mixed layer 66 can be formed in the same manner as the mixed layer 63 of FIG. 10 is formed, i.e., by introducing carbon into the thickness region of the vane 6 adjacent to the outer surface of the interlayer 65. The introduction of carbon can be accomplished, for example, by operating the above-described ECR plasma CVD apparatus to cause a substrate such as the vane 6 to produce a negative self-bias voltage at an early stage of film formation.

A hard carbon film 67 is formed on the mixed layer 66. The presence of the mixed layer 66 contributes to the improved adherence of the hard carbon film 67 to the interlayer 65.

In this second aspect, if the mixed layer is desired to be made thicker than the interlayer, the mixed layer may also be formed in the underlying substrate adjacent to its surface so that it extends through the interlayer into the substrate.

Figure 16:
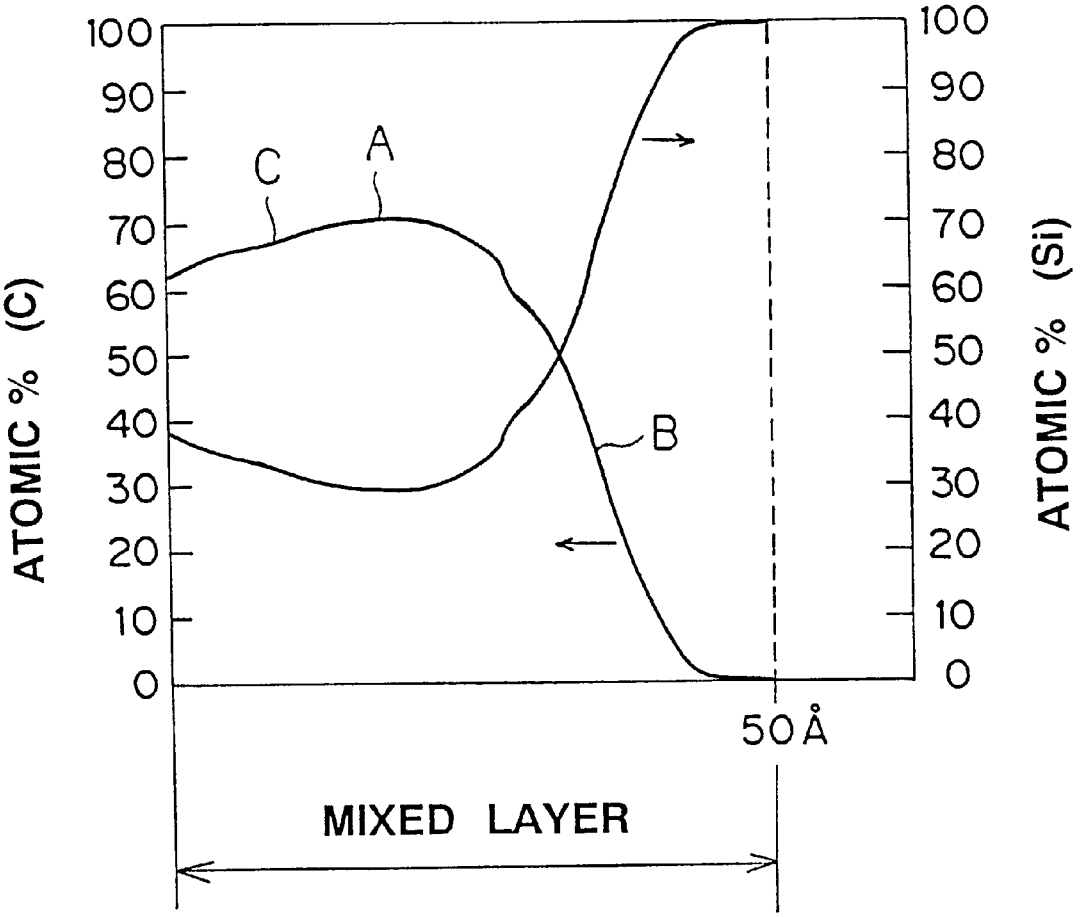
FIG. 16 are graphs showing composition gradients in a thickness direction of a mixed layer in the embodiments in accordance with the present invention.

FIG. 16 is a graph showing a composition gradient in a thickness direction of the mixed layer formed within the interlayer. In this particular embodiment, the interlayer consists of Si. A RF power was applied to a substrate holder so that the self-bias voltage produced in a substrate was set at −50 V in an early stage of film formation. Otherwise analogously to the manner as employed in the above embodiment, a hard carbon film was formed on the Si interlayer.

As shown in FIG. 16, the carbon content reaches to zero at a depth of 50 Å from a surface of the mixed layer. The thickness of the mixed layer is about 50 Å. The mixed layer exhibits a maximum carbon content of about 70 atomic percent at a site A which is located at a depth of about 35% of a whole thickness of the mixed layer from the outer surface of the mixed layer. As also shown in FIG. 16, the mixed layer has a mixed layer portion within which a carbon content in a thickness portion closer to the mixed layer surface is higher than in a thickness portion remoter from the mixed layer surface to define a carbon content gradient B. The mixed layer has another mixed layer portion extending from its outer surface to the site A within which a carbon content in a thickness portion closer to the outer surface of the mixed layer is slightly decreasing to define a carbon content gradient A. The improved adhesion of the hard carbon film to the mixed layer is assured by establishing such a carbon content gradient within the mixed layer that a carbon content in a thickness portion adjacent or closer to the outer surface of the mixed layer is higher than in a thickness portion opposite to or remoter from the outer surface of the mixed layer.

The thickness of the mixed layer can be controlled such as by varying the self-bias voltage produced in the substrate. For example, in case of the Si interlayer, if the self-bias voltage across the substrate is controlled at −1 KV in an early stage of film formation, the mixed layer can be formed to a thickness of about 130 Å.

A Si interlayer was formed on a vane to a thickness of 100 Å. A hard carbon film was subsequently formed on the Si interlayer. A self-bias voltage was varied during film formation in the manner as illustrated in FIG. 11. The resulting hard carbon film had a thickness of 5000 Å and a Vickers hardness of 3000 Hv. The hard carbon films formed were subjected to a scratch test for adherence evaluation. No sample thereof showed delamination.

Figure 17:
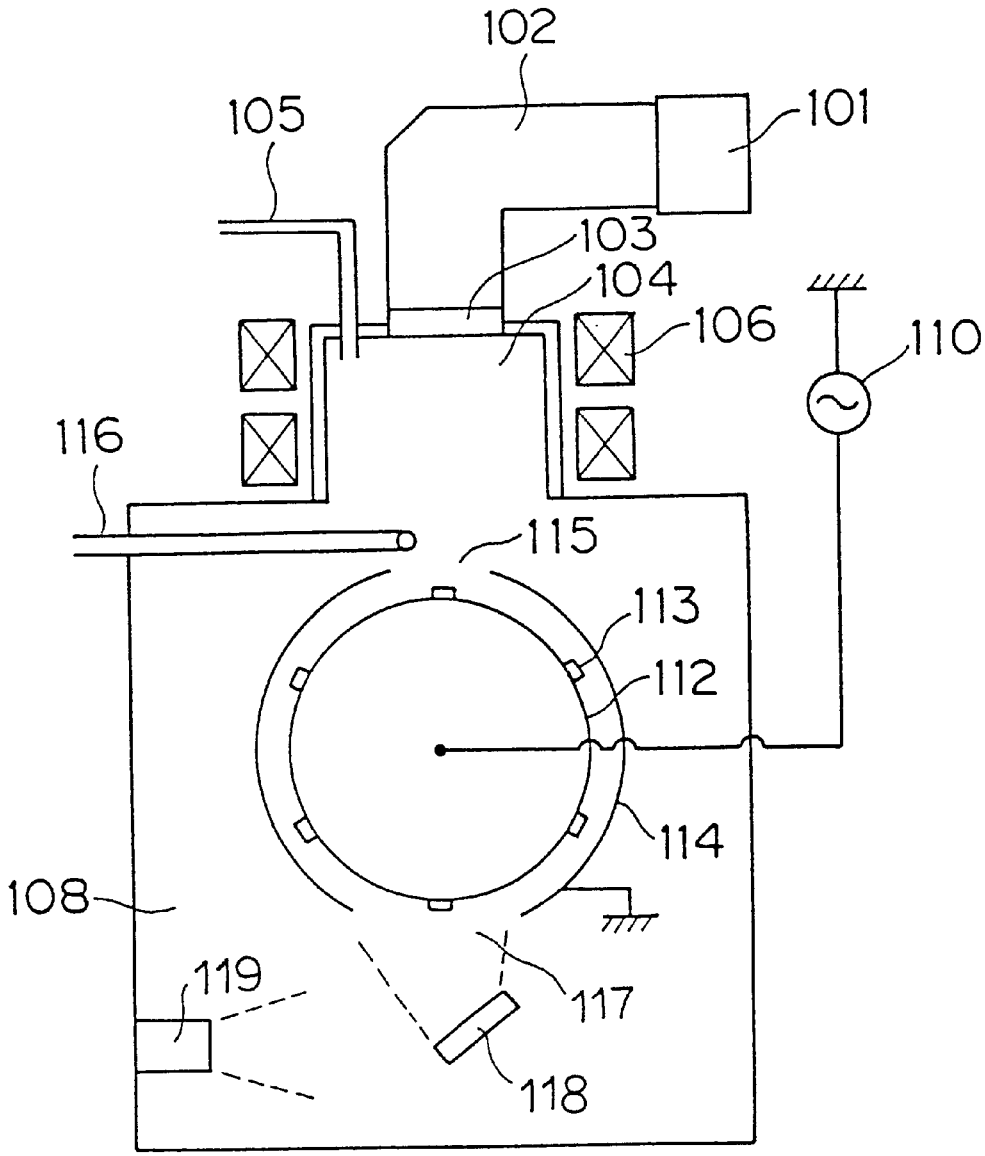
FIG. 17 is a schematic cross-sectional view of another exemplary ECR plasma CVD apparatus as employed for the embodiments in accordance with the present invention.

Next, a hard carbon film was formed which contained an additive element. Such an hard carbon film containing the additive element was formed through an apparatus shown in FIG. 17. Referring to FIG. 17, in addition to having an opening 115 in the shield cover 114, the apparatus has a second opening 117 spaced from the opening 115. A target 118 is disposed to face toward the second opening 117. An ion beam gun 119 is disposed in such a location that the target 118 can be irradiated with an ion beam from the ion beam gun 119. The other constructions are analogous to respective ones of the apparatus of FIG. 4.

The target materials included Si, Ta, Cr and B. The hard carbon films containing any of those additive elements were formed using the apparatus shown in FIG. 17. The vane holder 112 was rotated during film formation, so that the carbon and additive element were deposited on each vane 113 through the opening 115 and the second opening 117, respectively. As a result, the hard carbon film containing the additive element was formed on each vane 113. The vane 113 had been precoated with an interlayer (100 Å thick) prior to film formation.

The target 118 was not employed when introducing N or F into a hard carbon film. Instead, a $N_2$ or $CF_4$ gas was introduced into a film formation atmosphere. More specifically, the $CH_4$ gas and a $N_2$ or $CF_4$ gas were supplied at respective partial pressures of $1.3\times10^{-3}$ and $1.0\times10^{-3}$ Torr.

The resulting hard carbon films were transferred to a surface characteristic tester for measurement of their friction coefficients and depths of wear. The friction coefficient was measured for Si, Ta and F while the depth of wear was measured for N, Cr and B. For comparative purposes, vanes carrying thereon neither the interlayer nor the hard carbon film, and vanes coated with the hard carbon film not containing the additive element were respectively prepared for measurement of their friction coefficients and depths of wear. For the depth of wear, a relative evaluation was made with respect to the hard carbon film not containing the additive element. The results are given in the following Table 2. For measurement, an aluminum ball indenter was employed which slidingly reciprocated two thousand times.

TABLE 2

| Additive Element | | Friction Coefficient | Wear Depth (Relative Value) |
|---|---|---|---|
| Type | Si | 0.1 | — |
| | Ta | 0.13 | — |
| | F | 0.12 | — |
| | N | — | 0.6 |
| | Cr | — | 0.8 |
| | B | — | 0.7 |
| | None | 0.18 | 1 |
| W/O Hard Carbon Film and Interlayer | | 0.5 | 4 |

As apparent from Table 2, the inclusion of additive elements in the resulting hard carbon films impart thereto improved friction coefficients and wear depths.

The content of the additive element may be made higher in a thickness portion of the hard carbon film closer to its outer surface than in a thickness portion thereof remoter from its outer surface. The provision of such a content gradient of the additive element improves the adherence of the resulting hard carbon film.

Figure 18:
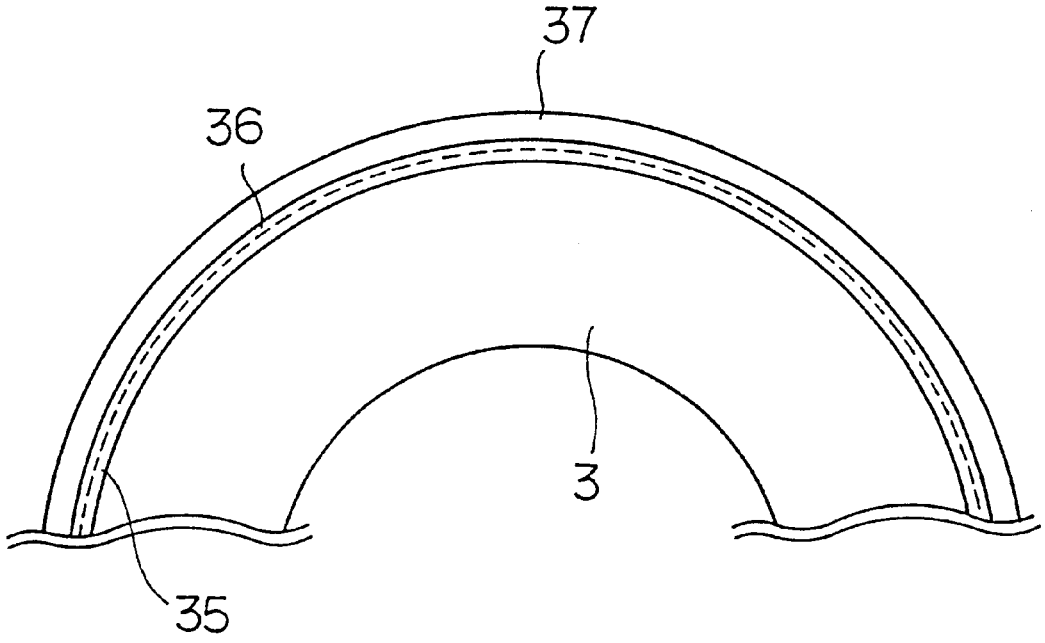
FIG. 18 is a schematic cross-sectional view showing another embodiment in accordance with the second aspect of the present invention.

FIG. 18 is a partly cutaway schematic cross-sectional view showing another embodiment in accordance with the second aspect of the present invention. An interlayer 35 is formed on a roller 3. A mixed layer 36 is formed within the interlayer 35 adjacent to an outer surface of the interlayer 35. A hard carbon film 37 is formed on the interlayer 35. The mixed layer 36 can be formed in the interlayer 35 analogously to the embodiment of FIG. 14. The formation of the mixed layer 36 in the interlayer 35 enhances its adhesion to the hard carbon film 37.

Figure 19:
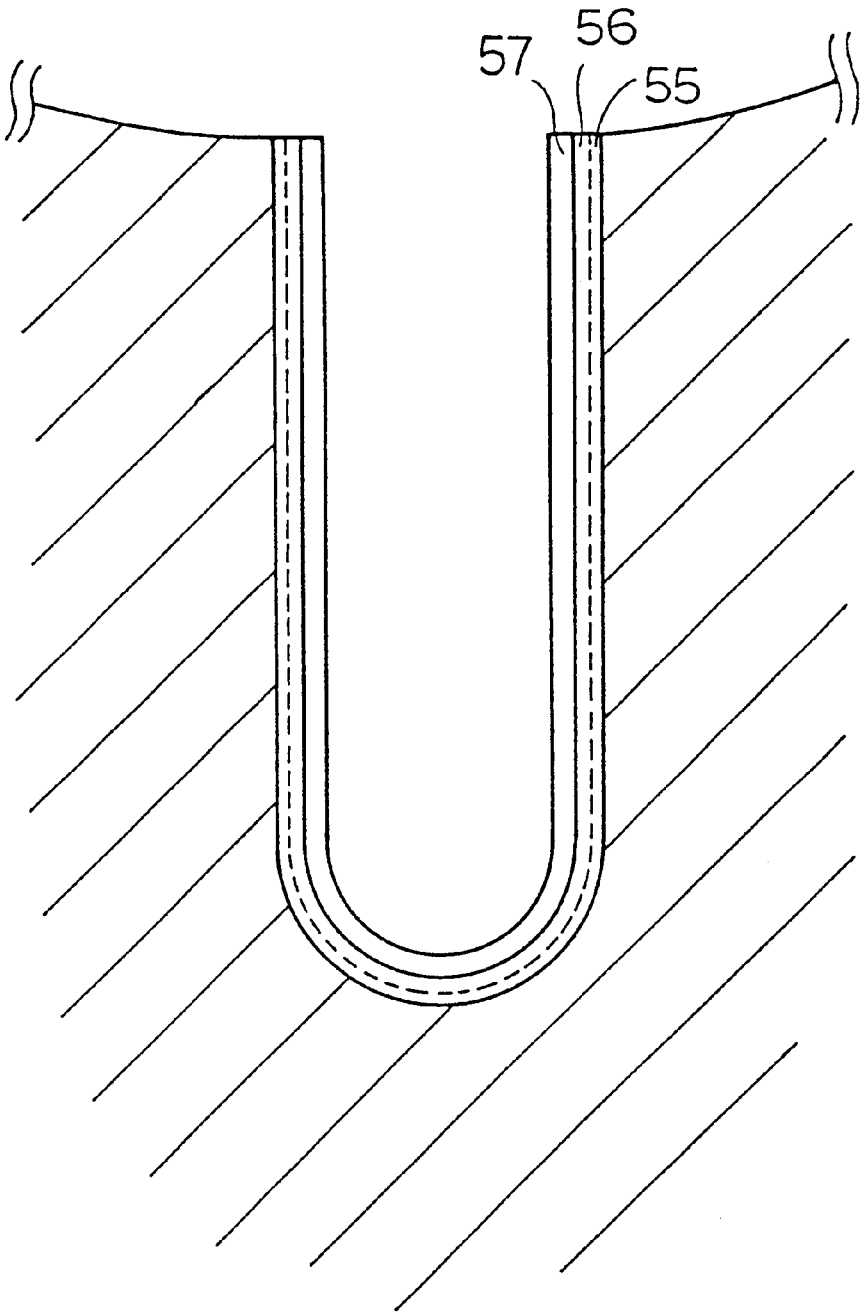
FIG. 19 is a schematic cross-sectional view showing still another embodiment in accordance with the second aspect of the present invention.

FIG. 19 is a partly cutaway schematic cross-sectional view showing still another embodiment in accordance with the second aspect of the present invention. An interlayer 55 is formed on an inner surface of a cylinder channel 5. A mixed layer 56 is formed within the interlayer 55 adjacent to an outer surface of the interlayer 55. A hard carbon film 57 is formed on the interlayer 55. The mixed layer 56 can be formed in the interlayer 55 analogously to the embodiment of FIG. 14. The formation of the mixed layer 56 in the interlayer 55 enhances its adhesion to the hard carbon film 57.

In the above embodiments, the series of interlayer and hard carbon film was formed on an extensive surface area of the vane. However, they may be formed only on the surface area of a leading end of the vane.

Although the rotary compressor components were exemplarily used in the above embodiments to explain the members having a sliding contact surface in accordance with the present invention, the present invention is not limited to those rotary compressor components. The present invention is applicable to a cylinder or piston of a reciprocating compressor, further to an outer surface of an O-ring mounted to the piston, for example.

Figure 20:
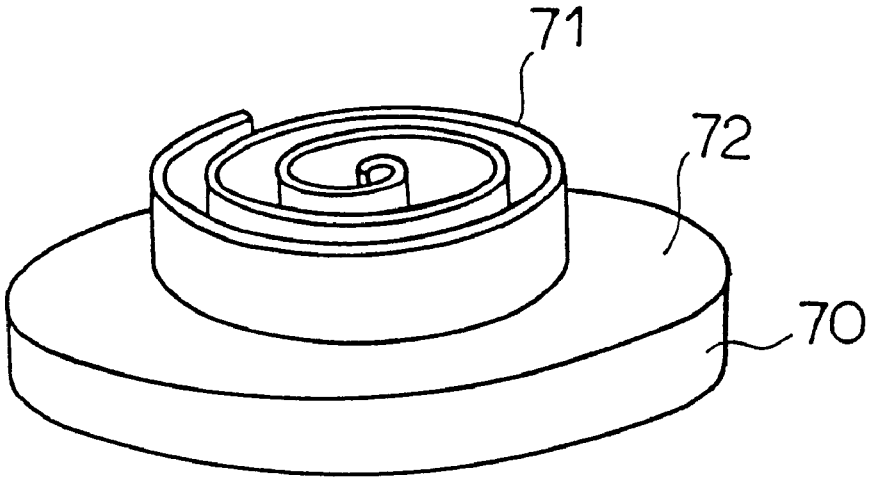
FIG. 20 is a perspective view of a scroll for use in a scroll type compressor.

FIG. 20 is a perspective view of a scroll for use in a scroll compressor. The present invention is applicable to such a scroll 70. A lapped portion 71 and a mirror plate 70 of the scroll 70 provide sliding contact surfaces respectively.

Also, the member having a sliding contact surface in accordance with the present invention is not limited to compressor components, and is applicable to a variety of members which includes a sliding contact surface. For example, the present invention may be applied to such a member as an inner or outer blade edge of an electric shaver. Furthermore, the present invention is applicable to a sliding portion of a thin layer magnetic head for use in hard disk drives, VTR cylinders, and outer surfaces of optical magnetic disks.

What is claimed is:

1. A member comprising:

a main body having a sliding contact surface;

an interlayer provided on said sliding contact surface of the main body;

a hard carbon film provided on said interlayer;

a mixed layer formed within a thickness region of said interlayer adjacent to the sliding contact surface thereof and containing carbon and a constituent element of the interlayer;

said mixed layer having a carbon content gradient in its thickness direction so that a carbon content in a thickness portion thereof closer to an outer surface of the mixed layer is higher than in a thickness portion thereof remoter from the outer surface of the mixed layer; and wherein said mixed layer is formed by introducing the carbon into the thickness region of the interlayer adjacent to an outer surface of the interlayer, and said interlayer is formed of Si, Ti, Zr, Ge, Ru, Mo, W.

2. The member of claim 1, wherein a thickness of said mixed layer is at least 5 Å.

3. The member of claim 1, wherein said hard carbon film has a hydrogen content gradient in its thickness direction so that a hydrogen content in a thickness portion thereof remoter from an outer surface of the hard carbon film is higher than in a thickness portion thereof closer to the outer surface of the hard carbon film.

4. The member of claim 1, wherein said hard carbon film comprises a diamond thin film, a film having a mixed diamond and amorphous structure or an amorphous carbon thin film.

5. A compressor incorporating the member of claim 1.

6. A rotary compressor comprising:

a roller mounted eccentric to a rotatable crank shaft and having an outer periphery;

a hollow cylinder for accommodating said roller therein, said hollow cylinder having an inner surface in sliding contact with said outer periphery of the roller; and a vane received in a channel provided on said inner surface of the cylinder and having a leading end in sliding contact with said outer periphery of the roller, wherein said vane is said main body of the member of claim 1 and at least said leading end or a side portion of the vane constitutes said sliding contact surface.

7. A rotary compressor comprising:

a roller mounted eccentric to a rotatable crank shaft and having an outer periphery;

a hollow cylinder for accommodating said roller therein, said hollow cylinder having an inner surface in sliding contact with said outer periphery of the roller; and a vane received in a channel provided on said inner surface of the cylinder and having a leading end in sliding contact with said outer periphery of the roller, wherein said roller is said main body of the member of claim 1 and said outer periphery of the roller constitutes said sliding contact surface.

8. A rotary compressor comprising:

a roller mounted eccentric to a rotatable crank shaft and having an outer periphery;

a hollow cylinder for accommodating said roller therein, said hollow cylinder having an inner surface in sliding contact with said outer periphery of the roller; and a vane received in a channel provided on said inner surface of the cylinder and having a leading end in sliding contact with said outer periphery of the roller, wherein said hollow cylinder is said main body of the member of claim 1 and said inner surface of the hollow cylinder constitutes said sliding contact surface.

9. The member of claim 1, wherein said mixed layer includes a concentrated portion having a maximum carbon content of at least 20 atomic percent.

10. The member of claim 9, wherein said concentrated portion is present within a thickness region which covers 50% or less of a whole thickness of the mixed layer from the outer surface of mixed layer.

11. The member of claim 1, wherein said hard carbon film contains at least one additive element selected from the group consisting of Si, N, Ta, Cr, F and B.

12. The member of claim 11, wherein said hard carbon film has a content gradient of said additive element in its thickness direction so that an additive element content in a thickness portion thereof closer to the outer surface of the hard carbon film is higher than in a thickness portion thereof remoter from the outer surface of the hard carbon film.

* * * * *

UNITED STATES PATENT AND TRADEMARK OFFICE

CERTIFICATE OF CORRECTION

PATENT NO. : 6,299,425 B1
APPLICATION NO. : 09/500533
DATED : October 9, 2001
INVENTOR(S) : Hitoshi Hirano et al.

It is certified that error appears in the above-identified patent and that said Letters Patent is hereby corrected as shown below:

IN THE LETTERS PATENT:

Column 14, line 67, after "Mo," insert -- or --.

Signed and Sealed this

First Day of April, 2008

JON W. DUDAS
*Director of the United States Patent and Trademark Office*